US005580024A

United States Patent [19]

Briee

[11] Patent Number: 5,580,024

[45] Date of Patent: Dec. 3, 1996

[54] COMBINATION PORTABLE BOOK CARRYING DEVICE AND BOOKSTAND

[76] Inventor: Yves G. Briee, 2077 Mandarin Dr., Costa Mesa, Calif. 92626

[21] Appl. No.: 261,735

[22] Filed: Jun. 17, 1994

[51] Int. Cl.[6] ..... A47B 5/04

[52] U.S. Cl. ..... 248/444.1; 248/448; 248/451; 248/455; 248/460

[58] Field of Search ..... 248/447, 448, 248/451, 452, 454, 455, 457, 460, 444.1, 461; 40/120, 152.1, 155; 403/375, 381, 116

[56] References Cited

U.S. PATENT DOCUMENTS

| | | | |
|---|---|---|---|
| 290,381 | 12/1883 | Wood | 248/452 |
| 452,683 | 5/1891 | Walker | 248/451 |
| 1,053,114 | 2/1913 | Seaberg | 40/155 |
| 1,271,219 | 7/1918 | Pratt | 248/452 |
| 2,029,091 | 1/1936 | Bern | 40/152.1 |
| 2,662,333 | 12/1953 | Bargen | 248/455 |
| 3,707,791 | 1/1973 | Levy | 40/15.21 X |
| 4,116,413 | 9/1978 | Andersen | 248/451 |
| 4,150,807 | 4/1979 | Manso | 248/452 |
| 4,436,271 | 3/1984 | Manso | 248/460 |
| 4,466,601 | 8/1984 | Raines | 248/455 |
| 4,886,231 | 12/1989 | Doerksen | 248/455 |
| 5,375,806 | 12/1994 | Debus | 248/444.1 X |

*Primary Examiner*—Korie Chan

[57] ABSTRACT

A combination portable book carrying device and bookstand for supporting a book in an inclined readable position. The bookstand comprises an "L"-shaped base having a back support panel portion and a bottom support panel portion. At least two expandable arms are each positioned on a respective side of the back support panel and slidably supported relative thereto. Each arm is substantially "U"-shaped and comprises a rear portion being slidably positionable relative to the back support panel portion. A lateral portion depends from a back end thereof to the rear portion. An inwardly extending front portion depends from the front end of the lateral portions so as to accommodate a portion of the book within each arm. A bracket is pivotally connected to the back support panel portion for supporting a book at the desired reading angle such that the book may be closed and supported in such a closed position in the device.

4 Claims, 3 Drawing Sheets

COMBINATION PORTABLE BOOK CARRYING DEVICE AND BOOKSTAND

BACKGROUND OF THE INVENTION

1. Field of the Invention

The present invention relates to bookstands and more particularly to a combination portable book carrying device and bookstand.

2. Description of the Related Art

Frequently in studying, a student or reader props his book in an open position against objects and holds it in such an open position by placing another object thereagainst. Inasmuch as there are frequent problems associated with this method it is, therefore, generally more convenient to utilize a bookstand specially designed to carry books. However, such bookstands are often bulky and are therefore inconvenient to carry. Furthermore, these bookstands are often misplaced.

A patent search has revealed the following U.S. Patents:

U.S. Pat. No. 4,116,413, entitled "Collapsible Book Stand", discloses a bookstand with a rather complicated bracket system for supporting a book.

U.S. Pat. No. 4,886,231, entitled "Foldable Bookstand" discloses another bookstand formed from a rigid card with transverse hingelines dividing the card into a number of panels to form a base panel, and upstanding front panel, a rearwardly inclined edge receiving panel and upwardly inclined bookface receiving panel and a rearward support structure. Hook and loop fasteners are utilized. Additionally, separate arms are pivotally and swivally mounted on the front inclined surface so that they can project upwardly and rearwardly from outer edges thereof to outer edges of the book receiving panel to engage the outer edges of the book.

U.S. Pat. No. 4,436,271, entitled "Book Holding Device" discloses a device which consists of a base, having a hinged rod assembly secured to it. The assembly includes a pair of plastic sleeves with an adjustable and elevatable upper hook arrangement, for holding a book open, and a hinged rod assembly further including an adjustable lower hook arrangement for holding lower portions of the pages open.

U.S. Pat. No. 4,150,807, also entitled "Book Holding Device", discloses a device consisting primarily of a base, which includes a front panel, having a pair of elevatable hooks, which will render a book, or other reading material, secure and in open position, so as to enable a person to read comfortably without holding a book with his or her hands. One of the hooks of the device includes a small spring, for holding the side of the book having a few pages clustered together.

None of the aforementioned patents discloses a convenient, simple apparatus for holding a book at a desired reading angle and which serves as a carrying device for the book.

OBJECTS AND SUMMARY OF THE INVENTION

It is therefore a principal object of the present invention to provide a bookstand for supporting a book at a desired reading angle which can also serve to carry the book and therefore save space and also minimize the possibility of misplacement.

Another object of the present invention is to provide a bookstand which includes expandable arms which can accommodate variable widths of books.

Another object of the present invention is to provide a bookstand which provides ease in the turning of the book pages while being used.

These and other objects are achieved by the present invention which is a combination portable book carrying device and bookstand for supporting a book in an inclined readable position. The bookstand comprises an "L"-shaped base having a back support panel portion and a bottom support panel portion. At least two expandable arms are each positioned on a respective side of the back support panel and slidably supported relative thereto. Each arm is substantially "U"-shaped and comprises a rear portion being slidably positionable relative to the back support panel portion. A lateral portion depends from a back end thereof to the rear portion. An inwardly extending front portion depends from the front end of the lateral portions so as to accommodate a portion of the book within each arm. A bracket is pivotally connected to the back support panel portion for supporting a book at the desired reading angle such that the book may be closed and supported in such a closed position in the device.

Other objects, advantages and novel features of the present invention will become apparent from the following detailed description when considered in conjunction with the accompanying drawings.

DETAILED DESCRIPTION OF THE PREFERRED EMBODIMENTS

Figure 1:
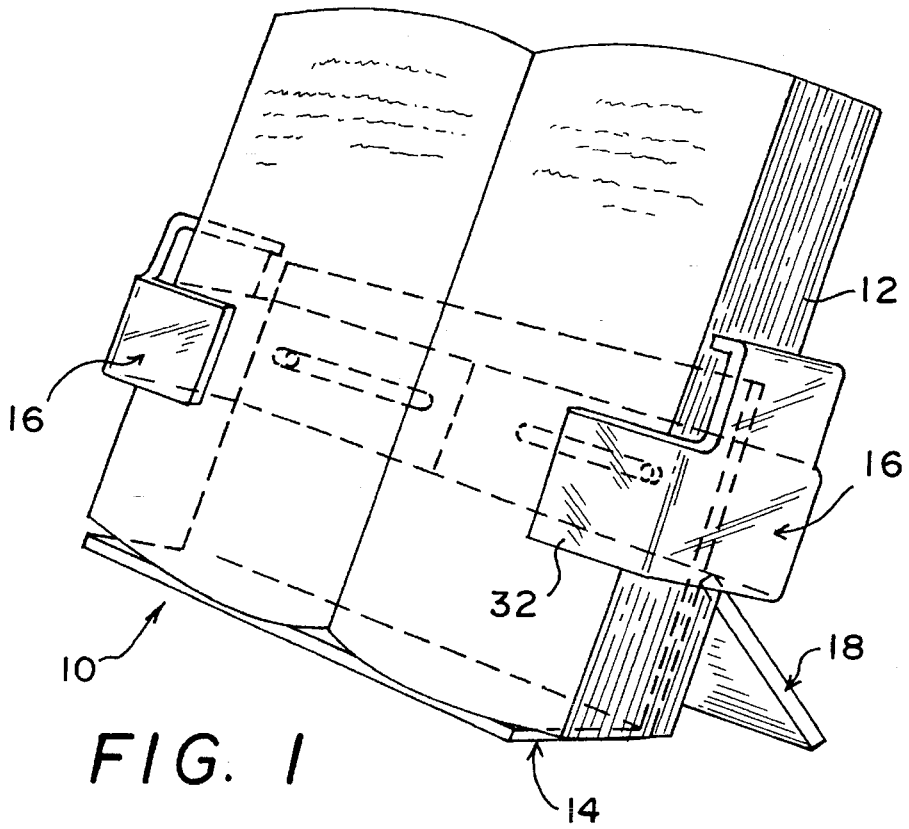
FIG. 1 is a front, right perspective view of the combination book carrying device and bookstand of the present invention with a book being supported in a reading position.

Referring now to the drawings and the characters of reference marked thereon, FIG. 1 illustrates a preferred embodiment of the present invention, designated generally as 10, shown with a book 12 being supported in a reading position. The book carrying device and bookstand 10 comprises an "L"-shaped base 14, two expandable arms 16, and a bracket 18 which is pivotally connected to the "L"-shaped base. As can be seen in this figure, when the arms 16 are extended, the book 12 may be supported in a convenient angle for reading.

Figure 2:
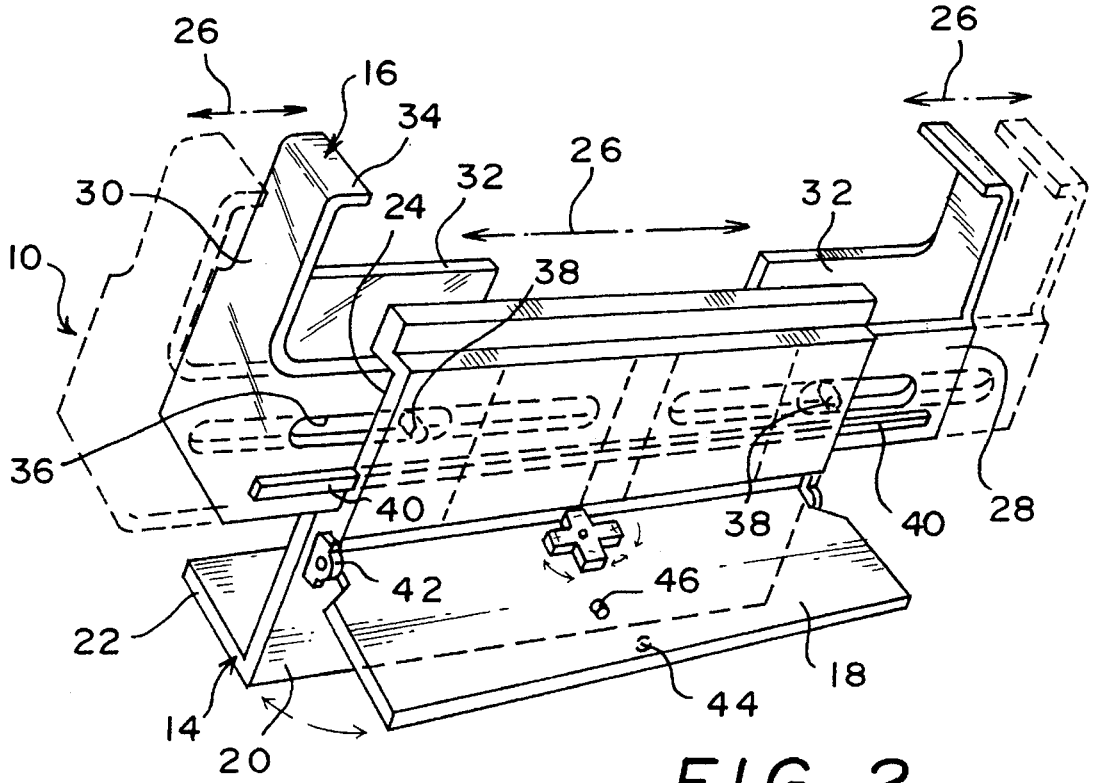
FIG. 2 is a rear, left perspective view of the carrying device and bookstand of the present invention.
Figure 6:
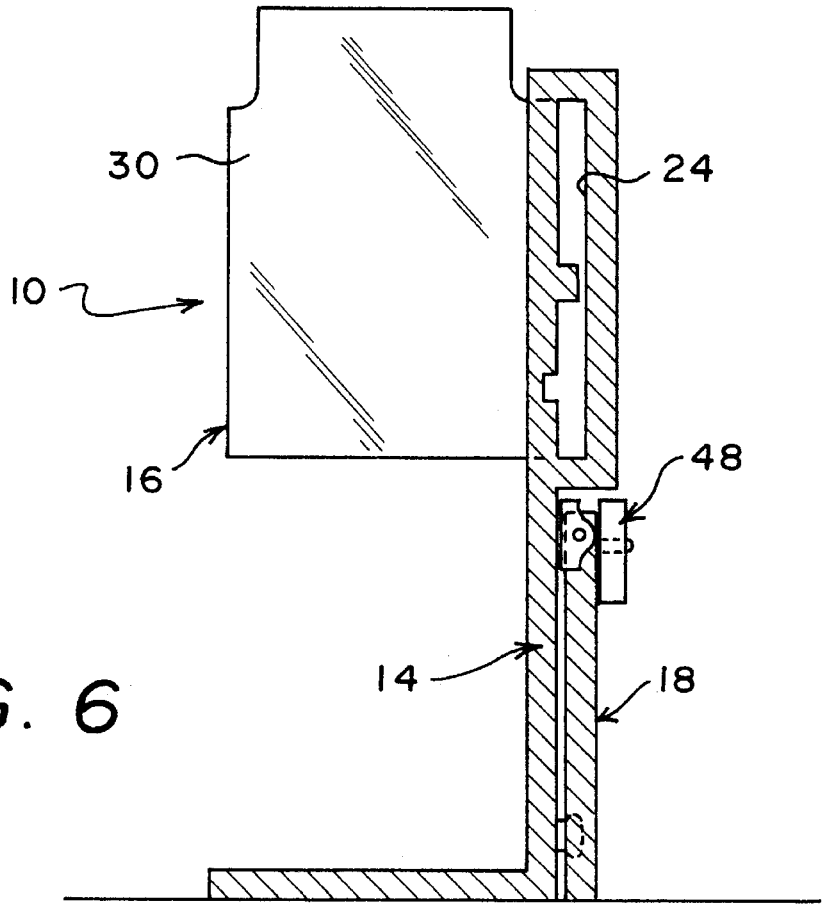
FIG. 6 is an end view of the present invention.

As can be more readily seen in FIG. 2, the "L"-shaped base 14 includes a back support panel portion 20 and a bottom support panel portion 22. The back support panel portion 20 includes an elongated guide rail 24 formed therein for slidably engaging the arms 16 so as to allow the arms to expand, in other words, move horizontally in and out, as shown by arrows 26. (The guide rail 24 may be most clearly seen in FIG. 6.)

Figure 3:
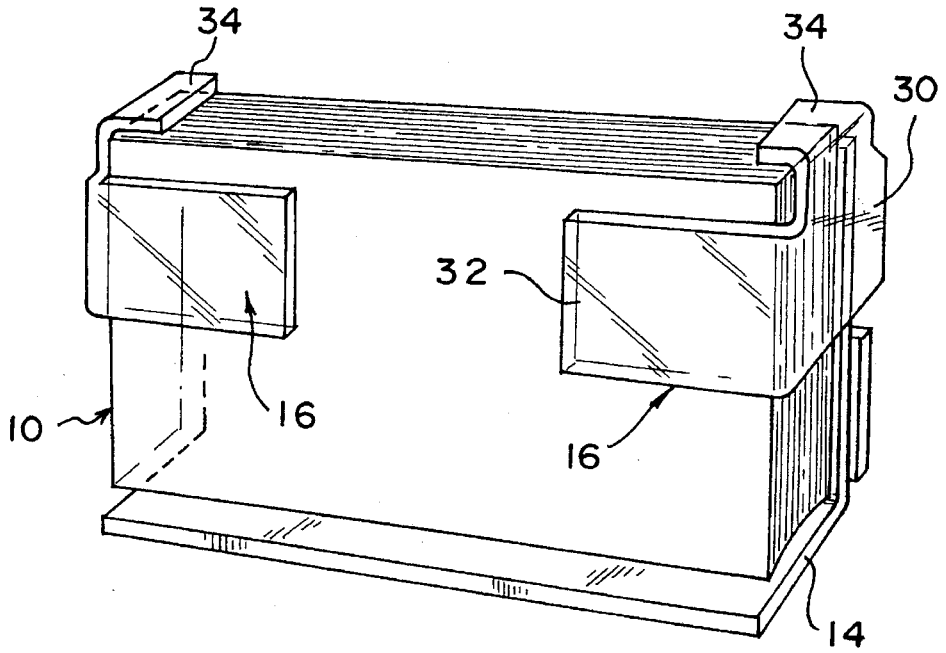
FIG. 3 is a front, right perspective view showing the book supported in a stowed position for carrying.

Each arm 16 is positioned on a respective side of the back support panel portion 20 and is slidably supported relative thereto. Each arm is substantially "U"-shaped (as viewed from the top or bottom) and comprises a rear portion 28 being slidably positioned relative to the back support panel portion 20 of the "L"-shaped base 14. A lateral portion 30 of each arm 16 depends, at a back end thereof, from the rear portion 28. An inwardly extending front portion 32 depends from a front end of the lateral portion 30 so as to accommodate a portion of a book within the arm 16. Each arm 16 preferably further comprises an inwardly extending top portion 34, depending from a top end of the lateral portion 30, to provide top support of a book when the carrying device and bookstand 10 is in a stowed position for carrying a book. This stowed orientation is shown in FIG. 3.

Referring again to FIG. 2, each arm 16 further has an elongated slot 36 which engages an associated post 38 extending through the slot 36 so as to enhance the efficiency of the guide rail 24, each post 38 serving as a stop to prevent the associated arm 16 from extending beyond the guide rail 24. Another horizontal support element 40 is also located on the arm 16 which engages an associated cut away portion of the back support panel portion 28 to provide enhanced support, especially when the arms are in the most extended position.

The bracket 18 is connected to the back support panel portion 20 via a hinge 42. A latch mechanism 44, 46 is provided to secure the bracket 18 against the back support panel portion 20 when the apparatus 10 is in the carrying, stowed position. Latch mechanism may comprise, a small latch, pin detach combination, or other convenient latch means.

Figure 4:
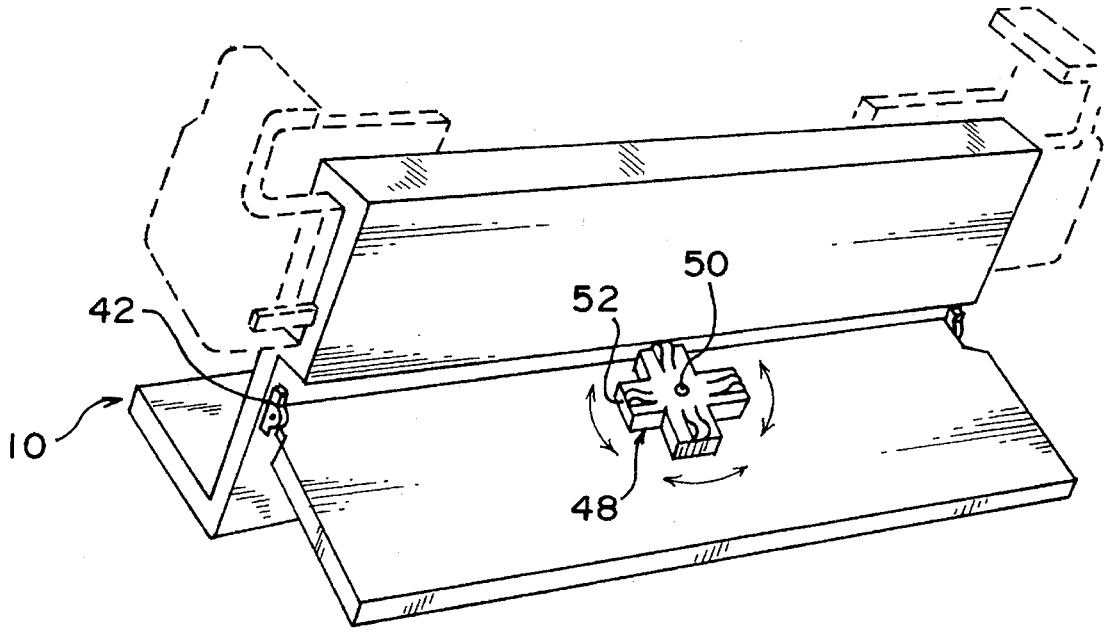
FIG. 4 is an enlarged rear perspective view of the present invention the use of the rotatable angle adjustor for the bookstand.
Figure 5:
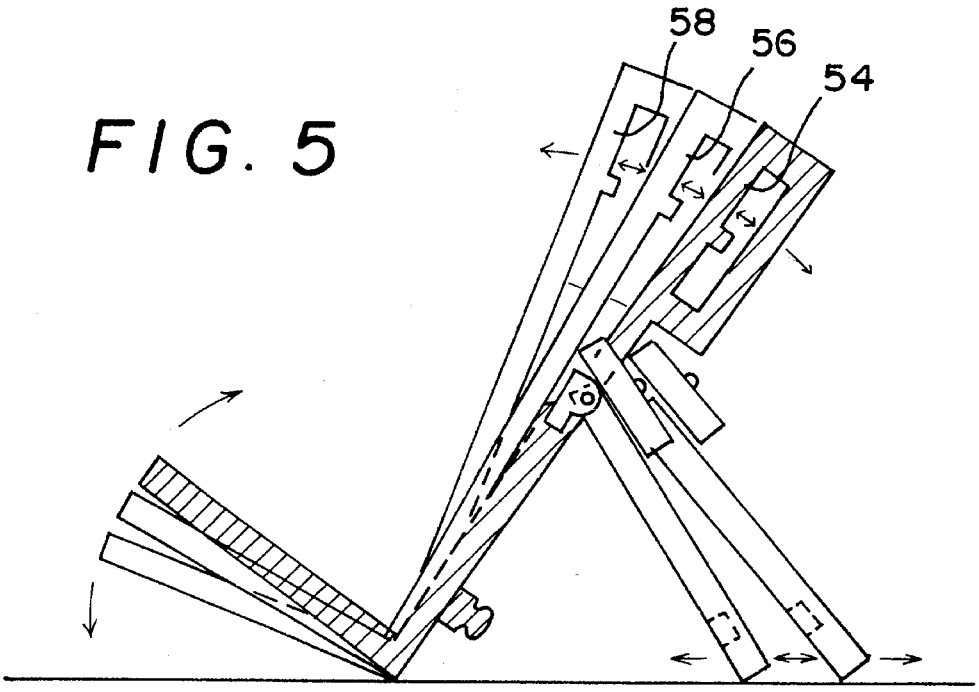
FIG. 5 is an end view of the lower portion bookstand, illustrating how the ample adjustor may be rotated to effect different reading angles.

Referring now to FIG. 4, a rotatable angle adjuster 48 is illustrated. The angle adjuster 48 comprises a central portion 50 with a plurality of radial outwardly extending arms 52 having different lengths. The central portion 50 of the angle adjuster 48 is rotatably connected to the bracket 18 wherein when an end of a selected arm 52 contacts the back support panel portion 20 the bracket 18 is extended so as to provide a desired reading angle. Three different positions are shown in FIG. 5, designated as 54, 56 and 58.

The present invention is preferably formed of a plastic material. The arms are preferably clear so that a book may be read while still engaged by the arms, without having to make any adjustment in the arms. The expandable arms accommodate variable widths of books, however, the present invention is preferably adapted and sized to conveniently support a paperback book.

Although not specifically shown in the drawings it may be convenient to slightly extend the width of the rear portion of the extendible arms near where that rear portion meets the lateral portion of the arm so as to provide a certain amount of friction locking when the arms are in the closed, stowed position. Other suitable means for maintaining these arms in the closed position are within the general purview of those skilled in manufacturing such similar plastic devices.

The present invention has a particular advantage in that there is great ease in page turning. The book does not need to be removed from the device in order to turn the pages. Instead, the page which is being turned simply slips away from one arm and slides between the previous page and the opposing arm.

Furthermore, the present invention includes very few moving parts which provides ease and simplicity in manufacturing.

When the user is finished reading, he simply closes the book, inserts it horizontally into the device, as shown in FIG. 3, closes the bracket and retracts the arms. The book is ready to be carried, supported by the device 10.

Obviously, many modifications and variations of the present invention are possible in light of the above teachings. It is, therefore, to be understood that within the scope of the appended claims, the invention may be practiced otherwise then as specifically described.

What is claimed and desired to be secured by Letters Patent of the United States is:

1. A combination portable book carrying device and bookstand for supporting a book in an inclined readable position, comprising:

(a) an "L"-shaped base having a back support panel portion and a bottom support panel portion;

(b) at least two expandable arms, each positioned on a respective side of said back support panel portion and being slidably supported relative thereto, each arm being substantially "U"-shaped, each arm comprising:
a rear portion being slidably positionable relative to said back support panel portion,
a lateral portion depending, at a back end thereof, from said rear portion, and
an inwardly extending front portion depending from a front end of said lateral portion, wherein said front portion is sufficiently spaced from said rear portion so as to accommodate a portion of said book within said arm; and (c) a bracket pivotally connected to said back support panel portion for supporting said book at a desired reading angle, said device for supporting said book in an open position as well as a closed position and, (d) a rotatable angle adjuster comprising a central portion with a plurality of radial outwardly extending arms having different lengths, said central portion of said angle adjuster being rotatably connected to said bracket wherein an end of a selected arm contacts said back support panel when the bracket is extended so as to provide a desired reading angle.

2. The combination portable book carrying device and bookstand of claim 1, wherein said "L"-shaped base, said at least two expandable arms, and said bracket are formed of plastic.

3. The combination portable book carrying device and bookstand of claim 1, wherein said at least two expandable arms are formed of clear plastic so that a book may be read while still engaged by said arms, without having to make any adjustment to the arms.

4. A combination portable book carrying device and bookstand or supporting a book in an inclined readable position, comprising:

(a) an "L"-shaped base having a back support panel portion and a bottom support panel portion;

(b) at least two expandable arms, each positioned on a respective side of said back support panel portion and being slidably supported relative thereto, each arm being substantially "U"-shaped, each arm comprising:
(b) a rear portion being slidably positionable relative to said back support panel portion,
a lateral portion depending, at a back end thereof, from said rear portion, and
an inwardly extending front portion depending from a front end of said lateral portion, wherein said front portion is sufficiently spaced from said rear portion so as to accommodate a portion of said book within said arm; and (c) a bracket pivotally connected to said back support panel portion for supporting said book at a desired reading angle, said device for supporting said book in an open position as well as a closed position, wherein each arm further comprises an inwardly extending top portion, depending from a top end of said lateral portion, to provide top support of the book when said carrying device and bookstand is in a stowed position for carrying the book.

* * * * *